US009348281B2

(12) United States Patent
Abe et al.

(10) Patent No.: US 9,348,281 B2
(45) **Date of Patent: *May 24, 2016**

(54) ELECTROPHOTOGRAPHIC FIXING MEMBER HAVING CURED SILICONE RUBBER LAYER WITH UNSATURATED ALIPHATIC GROUP AND ANATASE TYPE TITANIUM OXIDE CRYSTAL, FIXING APPARATUS AND ELECTROPHOTOGRAPHIC IMAGE FORMING APPARATUS

(71) Applicant: CANON KABUSHIKI KAISHA, Tokyo (JP)

(72) Inventors: Katsuya Abe, Tokyo (JP); Katsuhisa Matsunaka, Inagi (JP); Yasuhiro Miyahara, Tokyo (JP); Naoki Akiyama, Toride (JP); Hiroto Sugimoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/568,933

(22) Filed: Dec. 12, 2014

(65) Prior Publication Data

US 2015/0098739 A1 Apr. 9, 2015

Related U.S. Application Data

(63) Continuation of application No. PCT/JP2014/004353, filed on Aug. 25, 2014.

(30) Foreign Application Priority Data

Aug. 30, 2013 (JP) ..... 2013-179956

(51) Int. Cl.
*G03G 15/20* (2006.01)

(52) U.S. Cl.
CPC ..... *G03G 15/206* (2013.01); *G03G 15/2057* (2013.01); *G03G 2215/2051* (2013.01)

(58) Field of Classification Search
CPC ..... G03G 15/206; G03G 15/2057; G03G 2215/2048; G03G 2215/2051; G03G 2215/2054
USPC ..... 399/333; 428/421, 500
See application file for complete search history.

(56) References Cited

U.S. PATENT DOCUMENTS 5,763,068 A * 6/1998 Kishino et al. ..... 428/323
6,328,682 B1 * 12/2001 Shudo ..... 492/56

(Continued)

FOREIGN PATENT DOCUMENTS

JP 63-165887 A 7/1988
JP 2004-163715 A 6/2004

(Continued)

OTHER PUBLICATIONS

Machine English translation of Kamiya et al. Elastic Rotor for Fixing, Its Manufacturing Method and Image Forming Apparatus with Same, Mar. 31, 2005. Japanese Patent Office.*

(Continued)

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

An electrophotographic fixing member includes a substrate, a cured silicone rubber layer and a fluorine resin layer bonded onto the cured silicone rubber layer, wherein a micro hardness of a cured silicone rubber constituting the cured silicone rubber layer is designated as Hμ0, and a micro hardness of a rubber obtained by soaking the cured silicone rubber in a methyl hydrogen silicone oil for 24 hours and then further curing the cured silicone rubber, is designated as Hμ1, Hμ1/Hμ0 is 1.5 or more and 5.0 or less, and the cured silicone rubber layer comprises a titanium oxide crystal having an anatase type structure.

9 Claims, 5 Drawing Sheets

(56) References Cited

U.S. PATENT DOCUMENTS

| | | | | |
|---|---|---|---|---|
| 7,725,068 | B2 | 5/2010 | Matsunaka et al. | |
| 7,991,341 | B2 | 8/2011 | Matsunaka et al. | |
| 2009/0110453 | A1 * | 4/2009 | Kuntz et al. | 399/333 |
| 2014/0116603 | A1 | 5/2014 | Akiyama et al. | |
| 2014/0116611 | A1 | 5/2014 | Akiyama et al. | |
| 2014/0116612 | A1 | 5/2014 | Akiyama et al. | |
| 2014/0133892 | A1 | 5/2014 | Miura et al. | |

FOREIGN PATENT DOCUMENTS

| | | | |
|---|---|---|---|
| JP | 2005-084294 | A | 3/2005 |
| JP | 2009-244887 | A | 10/2009 |
| JP | 4597245 | B2 | 12/2010 |

OTHER PUBLICATIONS

Abe et al., U.S. Appl. No. 14/603,667, filed Jan. 23, 2015.

International Search Report in International Application No. PCT/JP2014/004353 (mailed Oct. 2014).

International Preliminary Report on Patentability with English Language Translation of Written Opinion in International Application No. PCT/JP2014/004353 (mailed Mar. 10, 2016).

* cited by examiner

ELECTROPHOTOGRAPHIC FIXING MEMBER HAVING CURED SILICONE RUBBER LAYER WITH UNSATURATED ALIPHATIC GROUP AND ANATASE TYPE TITANIUM OXIDE CRYSTAL, FIXING APPARATUS AND ELECTROPHOTOGRAPHIC IMAGE FORMING APPARATUS

CROSS-REFERENCE TO RELATED APPLICATIONS

This application is a continuation of International Application No. PCT/JP2014/004353, filed Aug. 25, 2014, which claims the benefit of Japanese Patent Application No. 2013-179956, filed Aug. 30, 2013.

BACKGROUND OF THE INVENTION

1. Field of the Invention

The present invention relates to a fixing member for use in a heat-fixing apparatus in an electrophotographic image forming apparatus such as a copier and a laser beam printer, and a fixing apparatus having the fixing member.

2. Description of the Related Art

In general, in a heat-fixing apparatus for use in an electrophotographic system, rotation members such as a pair of a heated roller and a roller, a film and a roller, and a belt and a roller are in pressure-contact with each other. When a material to be recorded, holding an image formed by an unfixed toner, is introduced to a pressure-contact portion formed between the rotation members, the unfixed toner on the material to be recorded is heated and molten to allow the image to be fixed on the material to be recorded. The rotation member with which the toner held on the material to be recorded is contact is referred to as a fixing member, and is called a fixing roller, a fixing film or a fixing belt depending on the form thereof.

As such a fixing member, a member is known in which a cured silicone rubber layer having heat resistance is disposed on a substrate made of a metal, a heat-resistant resin or the like, and covered with a fluorine resin with an addition curing type silicone rubber adhesive interposed therebetween. For formation of the cured silicone rubber layer, an addition curing type silicone rubber composition is often used from the viewpoint of processability.

The cured silicone rubber layer formed using the addition curing type silicone rubber composition has a crosslinking structure having a carbon-carbon bond built up by an addition reaction of an unsaturated aliphatic group in the addition curing type silicone rubber composition with an active hydrogen group bound to silicon (Si—H group) by heating. The cured silicone rubber layer has such a crosslinking structure to thereby exhibit excellent elasticity. The fixing member having the above configuration can enclose and melt a toner image, without excessively compressing and collapsing the toner image, by means of excellent elasticity of the cured silicone rubber layer. Therefore, the fixing member has an effect of preventing image displacement and bleeding to improve color mixing properties.

When the fixing member having the cured silicone rubber layer formed using the addition curing type silicone rubber composition is heated by a heat source such as a heater in a fixing process over a long period, however, the carbon-carbon bond in the crosslinking structure in the cured silicone rubber layer may be cleaved to deteriorate elasticity of the cured silicone rubber layer over time. Such a phenomenon is known as the aging phenomenon of a cured silicone rubber.

In the fixing member having the cured silicone rubber layer, the degree of elastic deformation may be thus changed over time in use, thereby resulting in the change in quality of an electrophotographic image over time. The fixing member has the important problem of having a suppressed change in elasticity of the cured silicone rubber layer, in order to ensure a stable image quality.

Against such a problem, Japanese Patent No. 4597245 discloses that it is effective to allow an unsaturated aliphatic group to be present in a cured silicone rubber layer. The reason for this is because, even if a carbon-carbon bond in the cured silicone rubber layer is cleaved, the unsaturated aliphatic group is present in the cured silicone rubber layer to thereby be subjected to a radical addition reaction, thereby building up a crosslinking structure again to suppress the deterioration in elasticity of the cured silicone rubber layer.

A fixing member disclosed in Japanese Patent No. 4597245 has a configuration in which an addition curing type silicone rubber adhesive is used to bond a fluorine resin layer onto the cured silicone rubber layer. Then, the surface of the cured silicone rubber layer in the fixing member is irradiated with ultraviolet ray in the production process of the fixing member. Thus, the surface of the cured silicone rubber layer can have an enhanced degree of crosslinking, and a dense structure can be formed. Therefore, an addition curing type silicone rubber adhesive having an active hydrogen group, with which the surface of the cured silicone rubber layer is to be coated, can be inhibited from being penetrated into the cured silicone rubber layer. As a result, the reaction of the unsaturated aliphatic group in the cured silicone rubber layer with the active hydrogen group in the addition curing type silicone rubber adhesive can be suppressed, and the unsaturated aliphatic group can be present in the cured silicone rubber layer in a large number.

SUMMARY OF THE INVENTION

As described above, the unsaturated aliphatic group is present in the cured silicone rubber layer in the fixing member according to Japanese Patent No. 4597245. Therefore, the deterioration in elasticity of the cured silicone rubber layer in use of the fixing member over a long time can be sufficiently suppressed.

The present inventors have made further studies about the fixing member having the configuration in which the addition curing type silicone rubber adhesive is used to bond the fluorine resin layer onto the cured silicone rubber layer, according to Japanese Patent No. 4597245.

As a result, it has been found that the deterioration in elasticity has been sometimes caused at the initial stage of use even in the fixing member provided with the cured silicone rubber layer containing the unsaturated aliphatic group. The reason for this is considered because cleavage of the crosslinking structure in the cured silicone rubber layer more predominantly occurs than building-up of the crosslinking structure by the radical addition reaction of the unsaturated aliphatic group in the cured silicone rubber layer at the initial stage of use, thereby causing the deterioration in elasticity of the cured silicone rubber layer.

In order to further stabilize the quality of an electrophotographic image, the present inventors have recognized that such deterioration in elasticity of the cured silicone rubber layer at the initial stage of use of the fixing member is required to be overcome.

The present invention is directed to providing a fixing member having a fluorine resin layer bonded and secured onto a cured silicone rubber layer, wherein the change in elasticity of the cured silicone rubber layer at the initial stage of use can be suppressed.

Further, the present invention is directed to providing a fixing member that stably provides a high-quality electrophotographic image, as well as a fixing apparatus and an electrophotographic image forming apparatus having the fixing member.

According to one aspect of the present invention, there is provided an electrophotographic fixing member comprising a substrate, a cured silicone rubber layer and a fluorine resin layer bonded onto the cured silicone rubber layer, wherein: when, a micro hardness of a cured silicone rubber constituting the cured silicone rubber layer is designated as Hμ0, and a micro hardness of a rubber obtained by soaking the cured silicone rubber in a methyl hydrogen silicone oil for 24 hours and then further curing the cured silicone rubber, is designated as Hμ1, Hμ1/Hμ0 is 1.5 or more and 5.0 or less, and wherein:

the cured silicone rubber layer comprises a titanium oxide crystal having an anatase type structure.

According to another aspect of the present invention, there is provided a fixing apparatus comprising the aforementioned electrophotographic fixing member, and a heating unit for the electrophotographic fixing member.

According to further aspect of the present invention, there is provided an electrophotographic image forming apparatus comprising an image formation unit having an electrographic photosensitive member, an image transferring unit and a fixing unit, wherein the fixing unit comprises the aforementioned fixing apparatus.

The present invention can provide an electrophotographic fixing member including a substrate, a cured silicone rubber layer and a fluorine resin layer bonded onto the cured silicone rubber layer, wherein elasticity of the cured silicone rubber layer can be more stably maintained. Furthermore, the present invention can provide an electrophotographic fixing member, a fixing apparatus and an electrophotographic image forming apparatus that can stably provide a high-quality electrophotographic image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present inventors have made various studies in order to achieve the above objects. As a result, it has been found that when a titanium oxide crystal having an anatase type structure (hereinafter, also referred to as "anatase type titanium oxide crystal") is contained in a cured silicone rubber layer that is sealed by a fluorine resin layer to be under a circumstance where supply of oxygen is blocked, the change in elasticity at the initial stage of use of a fixing member can be suppressed. The reason for this is considered because the anatase type titanium oxide crystal contained in the cured silicone rubber layer promotes a radical addition reaction of an unsaturated aliphatic group in the cured silicone rubber layer to allow a new crosslinking structure to be rapidly built up in the cured silicone rubber layer.

Specifically, a coating film of an addition curing type silicone rubber composition including the anatase type titanium oxide crystal on a substrate is cured to form the cured silicone rubber layer. Thereafter, the surface of the cured silicone rubber layer is coated with an addition curing type silicone rubber adhesive and a fluorine resin tube is pasted thereto, to form a fixing member.

As a result, it is confirmed that the deterioration in elasticity of the cured silicone rubber layer is alleviated as compared with the case where no anatase type titanium oxide crystal is compounded.

The reason for suppression of the deterioration in elasticity at the initial stage of heating the cured silicone rubber layer formed using the addition curing type silicone rubber composition including the anatase type titanium oxide crystal is presumed by the present inventors as follows.

That is, the anatase type titanium oxide crystal in the cured silicone rubber layer generates peroxide (ROOR) in the cured silicone rubber layer under a heating environment in use of the fixing member. Herein, "R" represents a group (an alkyl group or the like) derived from a hydrocarbon structure.

An oxy radical (RO.) derived from peroxide is here hardly scavenged by oxygen under an environment where supply of oxygen to the cured silicone rubber layer is substantially blocked by the fluorine resin layer, and thus can be stably present in the cured silicone rubber layer.

Therefore, the oxy radical promotes the radical addition reaction of the unsaturated aliphatic group in the cured silicone rubber layer, and the crosslinking structure is easily built up. As a result, the deterioration in elasticity of the cured silicone rubber layer at the initial stage of use of the fixing member is alleviated.

(1) Summary of Configuration of Fixing Member

The detail of the configuration of the fixing member according to the present invention is described with reference to the drawings.

Figure 1:
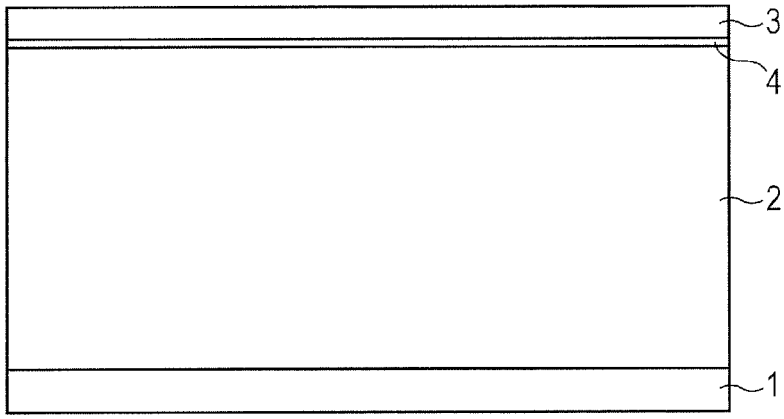
FIG. 1 is a partial schematic cross-sectional view of a fixing member according to the present invention.

FIG. 1 is a schematic cross-sectional view of a part of the electrophotographic fixing member according to the present invention. In FIG. 1, reference numeral 1 denotes a substrate, reference numeral 2 denotes a cured silicone rubber layer with which the periphery of the substrate 1 is covered, and reference numeral 3 denotes a fluorine resin layer. The fluorine resin layer 3 is secured on the periphery of the cured silicone rubber layer 2 by a cured silicone rubber adhesion layer 4.

(2) Substrate

As the material of the substrate 1, for example, a metal or an alloy such as aluminum, iron, stainless steel or nickel, or a heat-resistant resin such as polyimide is used. When the fixing member has a roller shape, a mandrel is used for the substrate 1. Examples of the material of the mandrel include metals and alloys such as aluminum, iron and stainless steel.

When the fixing member has a belt shape, examples of the substrate 1 include an electroforming nickel belt, and a heat-resistant resin belt made of polyimide or the like.

(3) Cured Silicone Rubber Layer and Production Method Thereof

The cured silicone rubber layer 2 functions as a layer that allows the fixing member to carry elasticity so that a toner is not collapsed by pressing in fixing. In order to exert such a function, the cured silicone rubber layer 2 can be a cured product of the addition curing type silicone rubber composition. The reason for this is because the degree of crosslinking can be adjusted depending on the type of a filler described later and the amount thereof added, to adjust elasticity.

The addition curing type silicone rubber composition is obtained by compounding and dispersing an additive such as a filler with and in an addition curing type silicone rubber stock liquid, and a crosslinking reaction along with hydrosilylation is allowed to progress by a measure such as heating, to thereby form the cured silicone rubber layer.

(3-1) Addition Curing Type Silicone Rubber Stock Liquid

In general, the addition curing type silicone rubber stock liquid is formed by an organopolysiloxane having an unsaturated aliphatic group, an organopolysiloxane having an active hydrogen group bound to silicon, a platinum compound as a crosslinking catalyst, and a curing controller (suppressor) called an inhibitor.

The organopolysiloxane having an unsaturated aliphatic group includes the following.

- Linear organopolysiloxane having any one or both intermediate units selected from the group consisting of an intermediate unit represented by $R^1{}_2SiO$ and an intermediate unit represented by $R^1R^2SiO$, and a molecular end represented by $R^1{}_2R^2SiO_{1/2}$.
- Branched organopolysiloxane having any one or both intermediate units selected from an intermediate unit represented by $R^1SiO_{3/2}$ and an intermediate unit represented by $SiO_{4/2}$, and a molecular end represented by $R^1{}_2R^2SiO_{1/2}$.

Herein, $R^1$ represents a monovalent unsubstituted or substituted hydrocarbon group including no unsaturated aliphatic group, bound to a silicon atom. Specific examples include the following.

- Alkyl groups (e.g., a methyl group, an ethyl group, a propyl group, a butyl group, a pentyl group and a hexyl group);
- Aryl groups (a phenyl group and the like);
- Substituted hydrocarbon groups (e.g., a chloromethyl group, a 3-chloropropyl group, a 3,3,3-trifluoropropyl group, a 3-cyanopropyl group and a 3-methoxypropyl group).

In particular, from the viewpoints that synthesis and handling are easy and an excellent heat resistance is achieved, it is preferable that $R^1$ represent a methyl group in a proportion of 50% or more, and it is particularly preferable that $R^1$ entirely represent a methyl group. $R^2$ represents an unsaturated aliphatic group bound to a silicon atom, examples thereof include a vinyl group, an allyl group, a 3-butenyl group, a 4-pentenyl group and 5-hexenyl group, and $R^2$ can represent a vinyl group from the viewpoints that synthesis and handling are easy and a crosslinking reaction is also easily performed.

A titanium oxide crystal or a thermally conductive filler is compounded to result in an increase in viscous properties of the addition curing type silicone rubber composition, and it is thus important for the organopolysiloxane having an unsaturated aliphatic group for use as a base agent to have a relatively low viscosity, namely, a small molecular weight. The organopolysiloxane is a polymer compound and thus the molecular weight thereof is difficult to completely specify, but the structure thereof can be confirmed using the weight average molecular weight (Mw) measured by size exclusion chromatography (GPC). Specifically, the weight average molecular weight is preferably 150,000 or less, further preferably 70,000 or less. If the molecular weight exceeds the value, structural viscous properties of the addition curing type silicone rubber composition is very high and thus molding processing is remarkably difficult.

The organopolysiloxane having an active hydrogen group bound to silicon is a crosslinking agent that forms a crosslinking structure by a reaction with an alkenyl group in the organopolysiloxane component having an unsaturated aliphatic group by means of the catalytic action of a platinum compound. The number of hydrogen atoms bound to a silicon atom is more than 3 on average in one molecule.

The organic group bound to a silicon atom includes an unsubstituted or substituted monovalent hydrocarbon group that is within the same range as $R^1$ in the organopolysiloxane component having an unsaturated aliphatic group. In particular, a methyl group can be adopted because of being easily synthesized and handled.

The molecular weight of the organopolysiloxane having an active hydrogen group bound to silicon is not particularly limited. The viscosity of the organopolysiloxane at 25° C. is preferably in a range of 10 $mm^2/_s$ or more and 100,000 $mm^2/_s$, or less, further preferably 15 $mm^2/_s$ or more and 1000 $mm^2/_s$ or less. The reason why the viscosity is limited within such a range is because no case is caused where the organopolysiloxane is volatilized in storage not to achieve a desired degree of crosslinking and desired physical properties of a molded product, and the organopolysiloxane is easily synthesized and handled, and easily uniformly dispersed in a system.

A siloxane backbone may be any of linear, branched and cyclic, and may be a mixture thereof. In particular, a linear siloxane backbone can be adopted because of being easy in synthesize. The active hydrogen group may be present in any siloxane unit in the molecule, but at least a part thereof can be present in the siloxane unit of a molecular end such as $R^1{}_2HSiO_{1/2}$.

The addition curing type silicone rubber stock liquid is preferably a solution in which the amount of the unsaturated aliphatic group is 0.1% by mol or more and 2.0% by mol or less, particularly preferably 0.2% by mol or more and 1.0% by mol or less, based on 1 mol of a silicon atom.

The addition curing type silicone rubber stock liquid can be compounded in a proportion of the active hydrogen group in the unsaturated aliphatic group of 0.3 or more and 0.8 or less. One reason for this proportion is because when the proportion is 0.3 or more, a crosslinking structure in which elasticity required as the cured silicone rubber layer of the fixing member can be sufficiently ensured can be built up. Another reason is because when the proportion is 0.8 or less, the unsaturated aliphatic group that remains without being reacted in a crosslinking reaction and is present in the cured silicone rubber layer can build up a crosslinking structure to sufficiently suppress the deterioration in elasticity of the cured silicone rubber layer. The ratio of the number of active hydrogen groups to the number of unsaturated aliphatic groups can be quantitatively determined and calculated by measurement using hydrogen nuclear magnetic resonance analysis (for example, $^1$H-NMR (trade name: AL400 Model FT-NMR; manufactured by Jeol Ltd.). The ratio of the number of active hydrogen groups to the number of unsaturated aliphatic groups can be within the above range to thereby stabilize the hardness of the cured silicone rubber layer.

(3-2) Filler;

The cured silicone rubber layer 2 includes a titanium oxide crystal having an anatase type structure, and can also include, in addition to a thermally conductive filler, other filler for the purposes of reinforcing, an enhancement in conductivity and an enhancement in heat resistance as long as the effect of the present invention is not impaired.

The cured silicone rubber layer according to the present invention can be high in thermal conductivity, and can contain a thermally conductive filler for the purpose of an enhancement in thermal conductivity.

(3-2-1) Titanium Oxide

The titanium oxide crystal is known to be present with having an anatase type structure or a rutile type structure. In the present invention, the titanium oxide crystal having an anatase type structure is used. Titanium oxide having a structure other than an anatase type structure may be included as long as the effect of the present invention is not impaired, but anatase type titanium oxide can be included in a larger amount. That is, the rate of rutile of the titanium oxide included in the cured silicone rubber can be calculated by the following calculation formula (1) according to the method of ASTM D 3720-84, and can be lower. Specifically, the rate of rutile is preferably 50% or less, particularly preferably 20% or less.

$$\text{Rate of rutile (\% by mass)} = 100-100/(1+1.2\times Ir/Ia) \qquad \text{Calculation formula (1)}$$

In calculation formula (1), Ir represents the peak area of the strongest interference line (plane indices: 110) of the rutile type structure in the titanium oxide crystal in the X-ray diffraction pattern, and Ia represents the peak area of the strongest interference line (plane indices: 101) of the anatase type structure in the titanium oxide crystal in the X-ray diffraction pattern.

In order to sufficiently exert the effect of the present invention, the titanium oxide crystal having an anatase type structure is preferably contained in a proportion of 0.2 parts by mass or more and 20 parts by mass or less in 100 parts by mass of the addition curing type silicone rubber stock liquid, in particular, further preferably 1 part by mass or more and 5 parts by mass or less. When the proportion is 0.2 parts by mass or more, the stability of elasticity of the cured silicone rubber layer can be sufficiently ensured. When the proportion is 20 parts by mass or less, the increase in structural viscous properties of the addition curing type silicone rubber can be suppressed. In order to sufficiently exert the effect of the present invention by the titanium oxide crystal in a small amount, the primary particle size of the titanium oxide crystal can be smaller, and is preferably 100 nm or less, further preferably 40 nm or less.

(3-2-2) Thermally Conductive Filler

The thermally conductive filler can be highly thermally conductive. Specifically, the filler includes inorganics, in particular, a metal, a metal compound and a carbon fiber. Specific examples of the highly thermally conductive filler include the following: silicon carbide (SiC); silicon nitride ($Si_3N_4$); boron nitride (BN); aluminum nitride (AlN); alumina ($Al_2O_3$); zinc oxide (ZnO); magnesium oxide (MgO); silica ($SiO_2$); copper (Cu); aluminum (Al); silver (Ag); iron (Fe); nickel (Ni); a vapor deposition carbon fiber; a PAN type (polyacrylonitrile) carbon fiber; and a pitch type carbon fiber. The fillers can be used singly or as a mixture of two or more. The average particle size of the highly thermally conductive filler can be 1 μm or more and 50 μm or less from the viewpoints of handling and dispersibility. In addition, the shape thereof can be spherical, ground, needle-shaped, plate-shaped or whisker-shaped, but can be spherical from the viewpoint of dispersibility.

The thermally conductive filler can be contained in the cured silicone rubber layer in the range from 30% by volume or more and 60% by volume or less based on the addition curing type silicone rubber, in order to sufficiently achieve the object.

(3-3) Thickness of Cured Silicone Rubber Layer

When the cured silicone rubber layer is adopted in the fixing member, if having a belt shape, the thickness thereof is preferably in the range of 100 μm or more and 500 μm or less, particularly preferably 200 μm or more and 400 μm or less, in terms of contribution to surface hardness and thermal conducting efficiency to an unfixed toner in fixing. If the cured silicone rubber layer has a roller shape, the thickness thereof is 0.5 mm or more and 4.0 mm or less.

(3-4) Method for Producing Cured Silicone Rubber Layer

Figure 2:
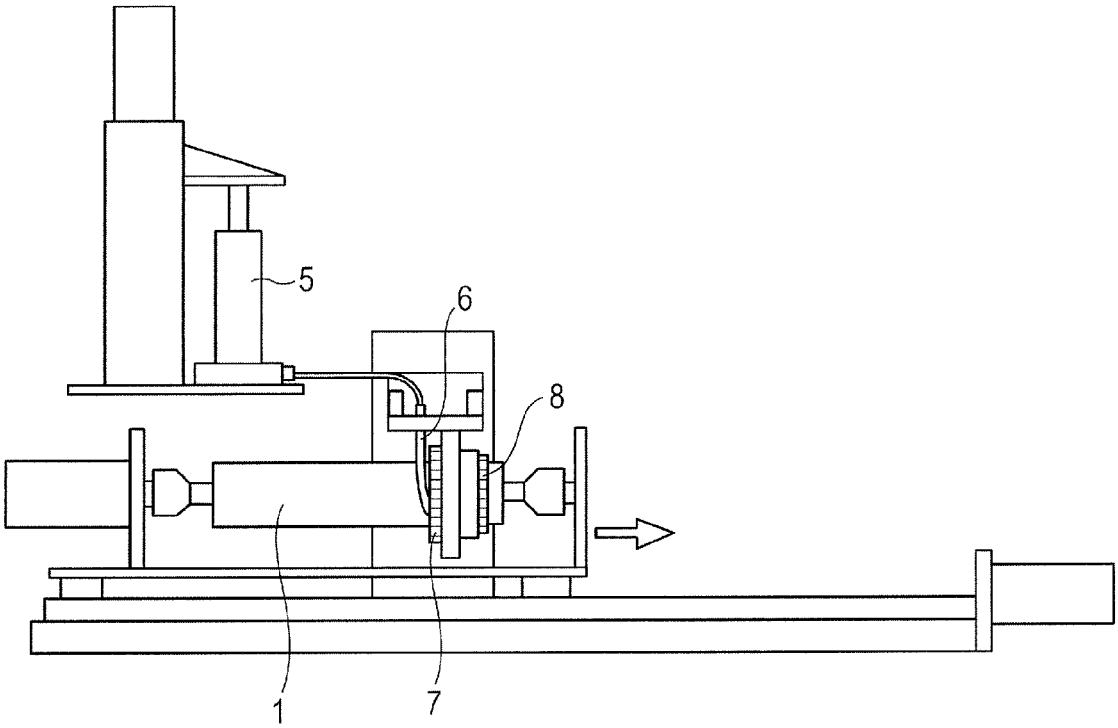
FIG. 2 is a schematic illustration view of one example of a step of forming a cured silicone rubber layer on a substrate, according to the present invention.

FIG. 2 illustrates one example of a step of forming the cured silicone rubber layer 2 on the substrate 1, and is a schematic view for illustrating a method using a so-called ring coating method. A cylinder pump 5 is filled with an addition curing type silicone rubber composition 8 in which the titanium oxide crystal and the filler are compounded in the addition curing type silicone rubber stock liquid, and feeds the composition 8 by pressure to thereby coat the periphery of the substrate 1 with the composition 8 from a coating liquid supply nozzle 6.

The substrate 1 can be allowed to move at a constant speed from a coating head 7 in the right direction in FIG. 2 at the same time with the coating, thereby forming a coating film of the addition curing type silicone rubber composition on the periphery of the substrate 1. The thickness of the coating film can be controlled by a clearance between the coating liquid supply nozzle 6 and the substrate 1, the supply speed of the addition curing type silicone rubber composition, the movement speed of the substrate 1, and the like. The layer of the addition curing type silicone rubber composition formed on the substrate 1 is heated by a heating unit such as an electric furnace for a certain time to allow the crosslinking reaction to progress for curing. Thus, the cured silicone rubber layer 2 as a cured product of the coating film of the addition curing type silicone rubber composition is formed.

(3-5) Degree of Presence of Unsaturated Aliphatic Group in Cured Silicone Rubber Layer As described above, while the cured silicone rubber layer in the present invention has an unsaturated aliphatic group, the amount of the unsaturated aliphatic group in the cured silicone rubber layer is difficult to directly observe. The amount, however, can be indirectly observed by the following method.

First, a plurality of thin pieces of a cured silicone rubber having a given size (for example, 20 mm×20 mm) are cut from the cured silicone rubber layer of the fixing member, and are stacked so that the thickness is 2 mm. Then, the Type C micro hardness of the laminate is measured using a Micro Rubber Durometer (Micro Rubber Durometer MD-1 capa Type C; manufactured by Kobunshi Keiki Co., Ltd.). The measurement value here is designated as Hμ0.

Then, all the thin pieces of the cured silicone rubber, forming the laminate, are completely soaked into a methyl hydrogen silicone oil (trade name: DOW CORNING TORAY SH1107FLUID; produced by Dow Corning Toray Co., Ltd.). The methyl hydrogen silicone oil is maintained at 30° C. and left to still stand for 24 hours (hereinafter, the treatment is also referred to as "soaking for 24 hours"). The methyl hydrogen silicone oil is thus penetrated into each of the thin pieces. Then, all the thin pieces subjected to the soaking treatment for 24 hours are taken out of the methyl hydrogen silicone oil, the oil on each surface thereof is sufficiently removed, and the resultant is heated in an oven at 200° C. for 4 hours and then cooled to room temperature. Thus, the reaction of the unsaturated aliphatic group with the methyl hydrogen silicone oil, as a main reaction, is completed with respect to all the thin pieces. Then, all the thin pieces are stacked, and the micro hardness of the resulting laminate is measured using the above apparatus. The micro hardness here is designated as Hμ1. Then, the rate of increase in hardness (=Hμ1/Hμ0) is calculated.

When the amount of the unsaturated aliphatic group in the cured silicone rubber layer is large, a new crosslinking point is formed in a test piece by the methyl hydrogen silicone oil penetrated into the test piece. Therefore, a significant increase in harness is exhibited in the test piece after the heat treatment. That is, the rate of increase in hardness exhibited is a relatively high value.

On the other hand, when the amount of the unsaturated aliphatic group in the cured silicone rubber layer is small, a new crosslinking point is hardly formed even if the test piece is soaked in the methyl hydrogen silicone oil and subjected to a heat treatment. Accordingly, the change in hardness of the test piece after the heat treatment is slight. That is, the rate of increase in hardness exhibited is a relatively small value.

The experiment for calculation of the rate of increase in hardness is not limited to the above conditions as long as the unsaturated aliphatic group in the test piece can be certainly reacted.

In the present invention, the rate of increase in hardness is preferably 1.5 or more, particularly preferably 2.0 or more. The reason for this is because the unsaturated aliphatic group is relatively abundantly present in the cured silicone rubber layer to effectively suppress the deterioration in elasticity due to aging.

The rate of increase in hardness is preferably 5.0 or less, particularly preferably 4.5 or less in terms of stability of the crosslinking structure in the cured silicone rubber layer.

Herein, the rate of increase in hardness can be controlled specifically by adjustment of the composition of the addition curing type silicone rubber stock liquid for use in formation of the cured silicone rubber layer.

That is, a mixing ratio of the organopolysiloxane having an unsaturated aliphatic group to the organopolysiloxane having an active hydrogen group bound to a silicon atom in the addition curing type silicone rubber stock liquid is adjusted to thereby adjust a ratio of the number of moles of the unsaturated aliphatic group to the number of moles of the active hydrogen group in the addition curing type silicone rubber stock liquid is adjusted. Specifically, a ratio of the number of moles of the unsaturated aliphatic group to the number of moles of the active hydrogen group can be high to thereby increase the amount of the unsaturated aliphatic group present in the cured silicone rubber layer. As a result, the rate of increase in hardness can be higher.

(4) Fluorine Resin Layer

As the fluorine resin layer 3, for example, a tube-shaped molded product of any resin recited below is used.

tetrafluoroethylene-perfluoro(alkyl vinyl ether) copolymer (PFA), polytetrafluoroethylene (PTFE), tetrafluoroethylene-hexafluoropyrene copolymer (FEP) and the like.

Among the materials recited above, PFA can be used from the viewpoints of moldability and toner releasing properties.

The thickness of the fluorine resin layer can be 50 μm or less. The reason for this is because the elasticity of the cured silicone rubber layer as a lower layer in stacking can be maintained to inhibit the surface hardness of the fixing member from being too high.

The inner surface of the fluorine resin tube can be subjected to a sodium treatment, an excimer laser treatment, an ammonia treatment or the like in advance to result in an enhancement in adhesiveness.

Figure 3:
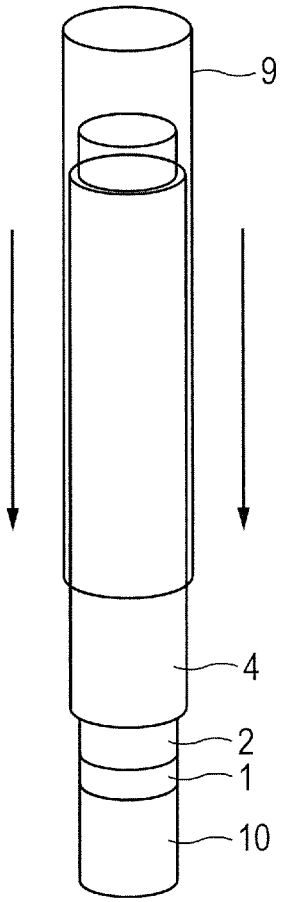
FIG. 3 is a schematic view of one example of a step of stacking a fluorine resin layer on a cured silicone rubber layer with an addition curing type silicone rubber adhesive interposed therebetween, according to the present invention.

FIG. 3 is a schematic view of one example of a step of stacking the fluorine resin layer on the cured silicone rubber layer 2 with the addition curing type silicone rubber adhesive interposed therebetween. If necessary, the surface of the cured silicone rubber layer 2 may be irradiated with ultraviolet ray using an ultraviolet lamp as in Japanese Patent No. 4597245.

The surface of the cured silicone rubber layer 2 is coated with an addition curing type silicone rubber adhesive 4. The outer surface of the cured silicone rubber layer 2 is covered with a fluorine resin tube 9 as the fluorine resin layer for stacking.

The covering method is not particularly limited, but a method in which the addition curing type silicone rubber adhesive is used as a lubricant for covering, a method in which the fluorine resin tube is expanded from the outside for covering, or the like can be used.

A unit not illustrated is used to squeeze out the excessive addition curing type silicone rubber adhesive remaining between the cured silicone rubber layer and the fluorine resin layer for removal. After the squeezing out, the thickness of the adhesion layer can be 20 μm or less.

Then, the adhesion layer can be heated by a heating unit such as an electric furnace for a given time to thereby cure and bond the addition curing type silicone rubber adhesive 4, and both ends thereof can be cut to a desired length to thereby provide a fixing belt as the fixing member of the present invention.

(5) Micro Hardness of Surface of Fixing Member

The Type C micro hardness of the surface of the fixing member can be measured using a Micro Rubber Durometer (Micro Rubber Durometer MD-1 capa Type C; manufactured by Kobunshi Keiki Co., Ltd.). The micro hardness here is preferably 60 degrees or more and 90 degrees or less, particularly preferably 70 degrees or more and 85 degrees or less.

The Type C micro hardness can be within the numerical value range to thereby inhibit an unfixed toner on a transfer medium from being excessively collapsed by pressing. As a result, a high-quality electrophotographic image with less image displacement and bleeding can be obtained.

Figure 4:
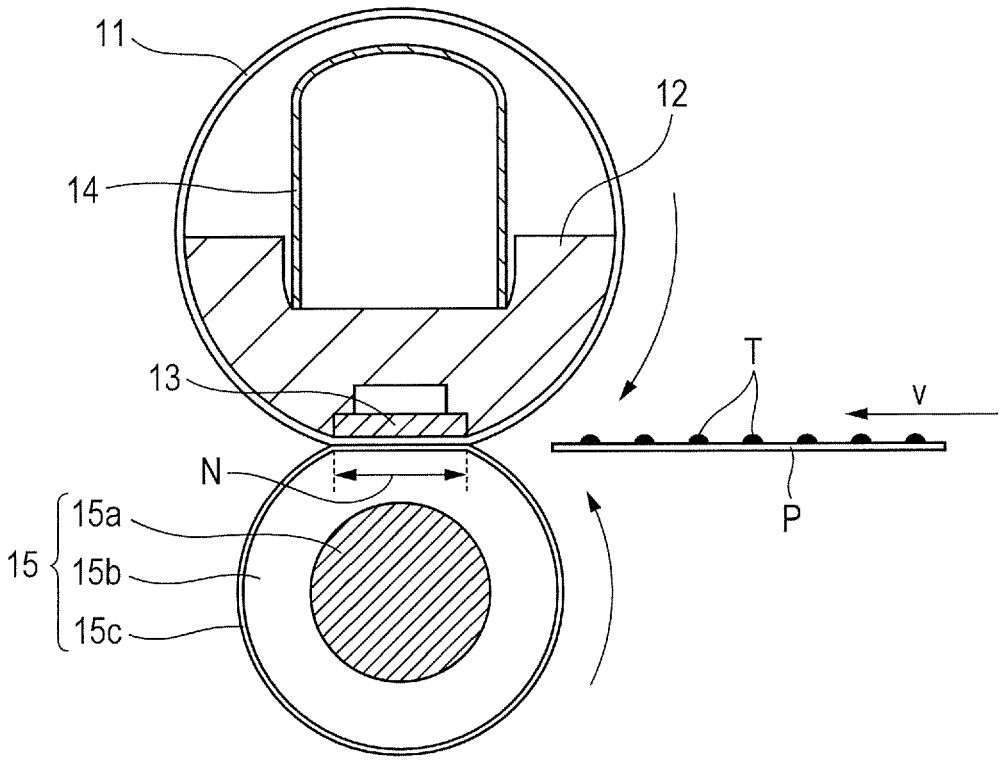
FIG. 4 is a lateral cross-sectional schematic view of a heat-fixing apparatus in which a belt-shaped electrophotographic fixing member according to the present invention is used.

(6) Fixing Apparatus;

FIG. 4 illustrates a lateral cross-sectional schematic view of a heat-fixing apparatus in which a belt-shaped electrophotographic fixing member according to the present invention is used. In the heat-fixing apparatus, numerical reference numeral 11 denotes a seamless-shaped fixing belt as a heating/fixing member according to one embodiment of the present invention. In order to hold the fixing belt 11, a belt guide member 12 is formed which is shaped by a heat resistant and heat insulating resin. A ceramic heater 13 as a heat source is provided at a position where the belt guide member 12 and the inner surface of the fixing belt 11 are in contact with each other. The ceramic heater 13 is secured and supported with being fitted in a groove portion shaped and provided along the longitudinal direction of the belt guide member 12. The ceramic heater 13 is electrified by a unit non-illustrated, to generate heat.

The seamless-shaped fixing belt 11 is externally fitted to the belt guide member 12 in a loose manner. A pressurizing rigid stay 14 is inserted in and passes through the inside of the belt guide member 12.

An elastic pressure roller 15 as a pressure member is one in which a cured silicone rubber layer 15*b* is provided on a stainless mandrel 15*a* to reduce surface hardness. Both ends of the mandrel 15*a* are disposed on the apparatus while being rotatably held by bearing between chassis plates (not illustrated) on the front side and on the back side. The elastic pressure roller 15 is covered with a fluorine resin tube of 50 μm as a surface layer 15*c* in order to enhance surface properties and releasing properties. A pushing-down force is afforded to the pressurizing rigid stay 14. The lower surface of the ceramic heater 12 disposed on the lower surface of the belt guide member 13 is thus in pressure-contact with the upper surface of the pressure member 15 with the fixing belt 11 interposed therebetween, to form a predetermined fixing nip portion N.

The fixing nip portion N is allowed to sandwich and convey a material to be recorded P serving as a subject to be heated, on which an image is formed by an unfixed toner T, at a predetermined velocity v. A toner image is thus heated and pressurized. As a result, the toner image is molten and color-mixed, and then cooled to thereby be fixed on the material to be recorded.

(7) Electrophotographic Image Forming Apparatus

Figure 5:
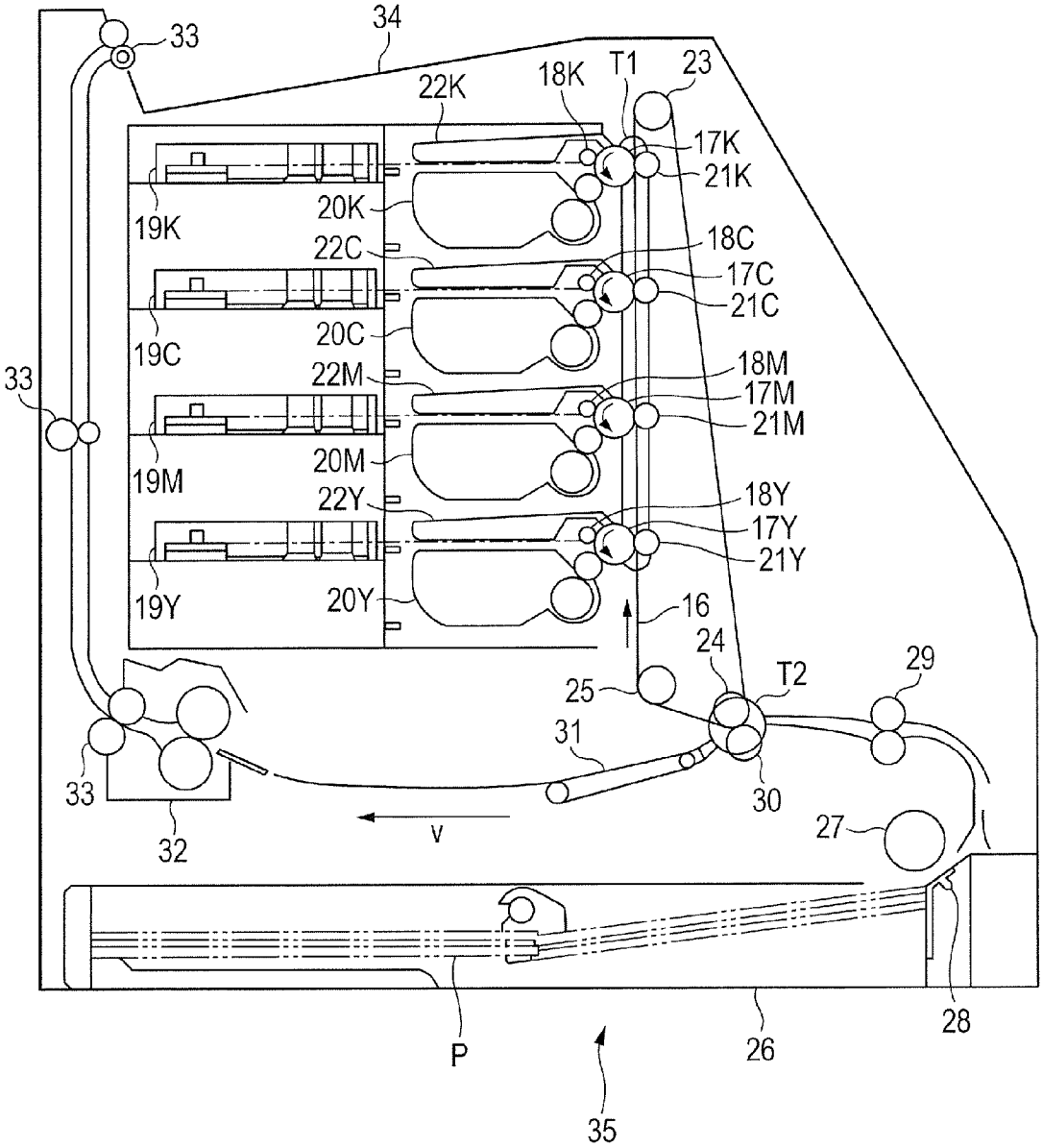
FIG. 5 is a schematic cross-sectional view of a color laser printer according to the present embodiment.

The entire configuration of the electrophotographic image forming apparatus is schematically described. FIG. 5 is a schematic cross-sectional view of a color laser printer according to the present embodiment. A color laser printer (hereinafter, referred to as "printer") 35 illustrated in FIG. 5 has an image formation unit having a drum-shaped electrographic photosensitive member (hereinafter, referred to as "photosensitive drum") that is rotated at a certain speed with respect to each color of yellow (Y), magenta (M), cyan (C) and black (K). The printer also has an intermediate transfer member 16 that holds a color image developed in the image formation unit and multiple-transferred and that transfers the color image to a recording medium P fed from a feeding portion. Photosensitive drums 17 (17Y, 17M, 17C, 17K) are rotatably driven by a driving unit (not illustrated) in a counterclockwise manner as illustrated in FIG. 5.

The photosensitive drums 17 are provided with charging apparatuses 18 (18Y, 18M, 18C, 18K) for uniformly charging the surface of each of the photosensitive drums 17, scanner units 19 (19Y, 19M, 19C, 19K) for radiating a laser beam based on image information to form an electrostatic latent image on each of the photosensitive drums 17, developing units 20 (20Y, 20M, 20C, 20K) for attaching a toner to the electrostatic latent image to develop the latent image as a toner image, primary transfer rollers 21 (21Y, 21M, 21C, 21K) for transferring the toner image on each of the photosensitive drums 17 to the intermediate transfer member 16 by a primary transfer portion T1, and units 22 (22Y, 22M, 22C, 22K) having a cleaning blade for removing a transfer residue toner remaining on the surface of each of the photosensitive drums 17 after transfer, arranged on the circumferences thereof in this order in the rotation direction.

The toner image of each color formed on each of the photosensitive drums is superimposed on a belt-shaped intermediate transfer member 16 extending over rollers 23, 24 and 25 in the image transferring unit and primary transferred to form a color image on the intermediate transfer member.

The recording medium is conveyed to a secondary transfer portion by a conveyance unit so as to be synchronized with the primary transferring to the intermediate transfer member 16. The conveyance unit has a feeding cassette 26 accommodating a plurality of the recording mediums P, a feeding roller 27, a separation pad 28 and a pair of resist rollers 29. In image formation, the feeding roller 27 is driven and rotated according to an image forming operation, and the recording mediums P in the feeding cassette 26 are separated one by one and conveyed to the secondary transfer portion by the pair of resist rollers 32 with being in time with the image forming operation.

A secondary transfer roller 30 is arranged in a movable secondary transfer portion T2. The secondary transfer roller 30 is movable in a substantially vertical direction. Then, the roller 30 is pressed on the intermediate transfer member 16 at a predetermined pressure with the recording medium P interposed, during image transferring. In the time, a bias is simultaneously applied to the secondary transfer roller 30 and the toner image on the intermediate transfer member 16 is transferred to the recording medium P.

The intermediate transfer member 16 and the secondary transfer roller 30 are separately driven, and thus the recording medium P sandwiched therebetween is conveyed in a left direction indicated in FIG. 5 at a predetermined velocity v, and further conveyed by a conveyance belt 31 to a fixing unit 32 as the next stage. In the fixing unit 32, heat and pressure are applied to fix the transferred toner image to the recording medium. The recording medium is discharged by a pair of discharge rollers 33 on a discharge tray 34 on the upper surface of the apparatus.

Then, the fixing apparatus according to the present invention illustrated in FIG. 4 can be applied to the fixing unit 32 of the color laser printer illustrated in FIG. 5 to thereby provide an electrophotographic image forming apparatus capable of providing a high-quality electrophotographic image with consumption energy being suppressed.

EXAMPLES

Hereinafter, the present invention will be more specifically described with reference to Examples.

Example 1

(1) The following materials (a) and (b) were compounded so that the ratio of the number of unsaturated aliphatic groups (vinyl groups) to the number of active hydrogen groups was 0.30, and a catalytic amount of a platinum compound was added thereto to provide an addition curing type silicone rubber stock liquid.

(a) vinylated dimethylpolysiloxane having at least two vinyl groups in one molecule (weight average molecular weight: 100000 (polystyrene equivalent));

(b) hydrogen organopolysiloxane having at least two active hydrogen groups in one molecule (weight average molecular weight: 1500 (polystyrene equivalent)).

A high-purity truly spherical alumina (trade name: Aluminabeads CB-A10S; produced by Showa Titanium Co., Ltd.) as a filler was compounded with the addition curing type silicone rubber stock liquid so that the volume ratio was 40%. Two parts by mass of a titanium oxide crystal having an anatase type structure (trade name: titanium oxide (IV), anatase type (containing rutile type), Model: 208-18231; produced by Wako Pure Chemical Industries, Ltd., rate of rutile:

8%) was further added thereto and the resultant was kneaded to thereby prepare an addition curing type silicone rubber composition. Then, an addition curing type silicone rubber composition having a Durometer hardness after curing according to JISK 6253A of 12° was obtained.

A nickel electroforming endless belt whose surface was subjected to a primer treatment, having an inner diameter of 30 mm, a width of 400 mm and a thickness of 40 μm, was prepared as a substrate. Herein, the endless belt was handled with a core 10 illustrated in FIG. 4 being inserted into the belt during a series of production steps.

The substrate was coated with the addition curing type silicone rubber composition by a ring coating method so that the thickness was 300 μm. The resulting endless belt was heated in an electric furnace set at 200° C. for 4 hours to cure the addition curing type silicone rubber composition, providing a cured silicone rubber layer.

While the surface of the endless belt was rotated at a movement speed of 20 mm/sec in the circumferential direction, an ultraviolet lamp placed at a distance of 10 mm from the surface was used to irradiate the cured silicone rubber layer with ultraviolet ray. A low pressure mercury ultraviolet lamp (trade name: GLQ500US/11; manufactured by Harrison Toshiba Lighting Co. Ltd.) was used for the ultraviolet lamp to perform irradiation at 100° C. for 5 minutes in an air atmosphere.

After being cooled to room temperature, the surface of the cured silicone rubber layer of the endless belt was coated with an addition curing type silicone rubber adhesive (trade name: SE1819CV; "A-liquid" and "B-liquid" produced by Dow Corning Toray Co., Ltd. were mixed in equal amounts) so that the thickness was about 20 μm. Then, a fluorine resin tube having an inner diameter of 29 mm and a thickness of 30 μm (trade name: KURANFLON-LT; produced by Kurabo Industries Ltd.) was stacked thereon.

Then, the endless belt was heated in an electric furnace set at 200° C. for 1 hour to cure the adhesive, securing the fluorine resin tube on the cured silicone rubber layer. Both ends of the resulting endless belt were cut to provide a fixing belt having a width of 341 mm.

The interface between the substrate and the cured silicone rubber layer of the resulting fixing belt, and the interface between the adhesion layer and the cured silicone rubber layer thereof were cut and separated by a razor blade to remove the substrate as well as the adhesion layer and the fluorine resin tube from the fixing belt. The thickness of the resulting cured silicone rubber layer having an endless belt shape was about 270 μm. A plurality of 20 mm-square rubber pieces were cut out from the cured silicone rubber layer.

Then, the rubber pieces were stacked so that the thickness was 2 mm, and the micro hardness (Hμ0) of the laminate was measured using a Type C micro durometer (trade name: Micro Rubber Durometer MD-1 capa Type C; manufactured by Kobunshi Keiki Co., Ltd.). The measurement value was 27.5 degrees.

A beaker to which 50 mL of a methyl hydrogen silicone oil (trade name: DOW CORNING TORAYSH 1107 FLUID; produced by Dow Corning Toray Co., Ltd.) was loaded was prepared. All the rubber pieces forming the laminate were loaded to the beaker and soaked so that the whole of each of the rubber pieces was soaked. Then, a water bath set at a temperature of 30° C. was used to maintain the temperature of the oil in the beaker at 30° C., and left to still stand for 24 hours. Thereafter, the rubber pieces were taken out of the methyl hydrogen silicone oil, and the oil on the surface of each of the rubber pieces was sufficiently wiped by a wiper (trade name: Kimwipe S-200; manufactured by Nippon Paper Crecia Co., Ltd.). Then, each of the rubber pieces was loaded to an oven set at 200° C., heated for 4 hours, and then cooled to room temperature. Each of the rubber pieces was taken out of the oven and stacked again, and the micro hardness (Hμ1) of the laminate was measured in the same manner as described above. The measurement value exhibited 63.3 degrees.

Therefore, the rate of increase in hardness (Hμ1/Hμ0) of the cured silicone rubber layer of the fixing belt according to Example 1 was 2.3.

(2) A fixing belt was produced by the same method as the method described in (1) above.

A fixing belt 11 obtained above was charged to an electric furnace set at 240° C., and a plurality of 20 mm-square rubber pieces were cut out from each of the fixing belts after a lapse of 16 hours, after a lapse of 40 hours, after a lapse of 56 hours, after a lapse of 72 hours, after a lapse of 100 hours, after a lapse of 124 hours, after a lapse of 300 hours and after a lapse of 500 hours in the same manner as in (1) above. The rubber pieces cut out from each of the fixing belts were stacked so that the thickness was 2 mm, and the micro hardness (Hμ2) of the laminate was measured by a Type C micro durometer. The results are shown in Table 1. In addition, a graph illustrating a relationship between the hardness difference (=Hμ2−Hμ0) before and after heating and the heating time is illustrated in FIG. 6.

TABLE 1

| Elapsed time of heating (hours) | Hμ2 (degrees) |
|---|---|
| 0 | (Hμ0 = 27.5 degrees) |
| 16 | 27.3 |
| 40 | 26.6 |
| 56 | 26.4 |
| 72 | 25.9 |
| 100 | 25.4 |
| 124 | 25.6 |
| 300 | 27.4 |
| 500 | 29.1 |

Figure 6:
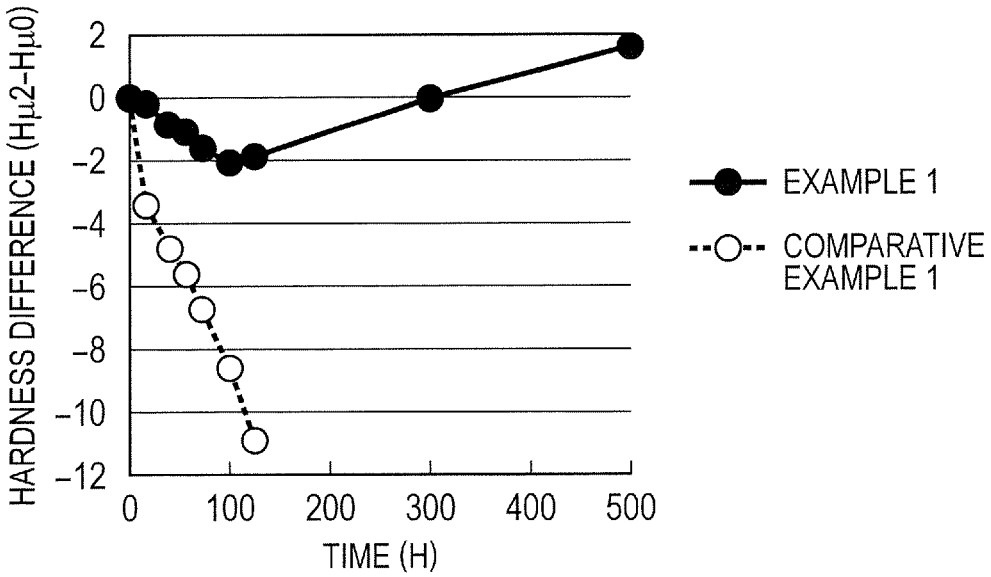
FIG. 6 is a graph illustrating a relationship between the heating time and the hardness difference of a fixing belt according to each of Example 1 and Comparative Example 1.

As illustrated in FIG. 6, the hardness after a lapse of 100 hours is reduced as compared with the initial hardness (Hμ0). The reason for this is considered because a part of the crosslinking structure in the cured silicone rubber is broken by heating. On the other hand, if the heating time is more than 100 hours, the hardness difference is decreased and the hardness after a lapse of 500 hours is higher than the initial hardness. The reason for this is considered because the unsaturated aliphatic group in the cured silicone rubber layer is reacted to thereby build up a new crosslinking structure.

Comparative Example 1

The titanium oxide crystal having an anatase type structure was not compounded and the amounts of the vinylated dimethylpolysiloxane and the hydrogen organopolysiloxane compounded in the addition curing type silicone rubber stock liquid were adjusted so that the rate of increase in hardness (Hμ1/Hμ0) of the cured silicone rubber was 1.1. A fixing belt was produced in the same manner as in Example 1 except for such conditions, and evaluated in the same manner as in Example 1. The Hμ0 value was 30.5 degrees. The Hμ2 value with respect to each heating time is also shown in Table 2. In addition, a graph illustrating a relationship between the hardness difference (=Hμ2−Hμ0) value before and after heating and the heating time is illustrated in FIG. 6.

TABLE 2

| Elapsed time of heating (hours) | Hμ2 (degrees) |
|---|---|
| 0 | (Hμ0 = 30.5 degrees) |
| 16 | 27.1 |
| 40 | 25.7 |
| 56 | 24.9 |
| 72 | 23.8 |
| 100 | 21.9 |
| 124 | 19.6 |
| 300 | Unmeasurable |
| 500 | Unmeasurable |

With respect to the fixing belt according to Comparative Example 1, the hardness of the cured silicone rubber was continuously decreased and could not be measured no longer after the heating time elapsed for 300 hours. The reason for this is considered because the unsaturated aliphatic group was hardly present in the cured silicone rubber layer of the fixing belt according to Comparative Example 1 and therefore no crosslinking structure was built up again after the crosslinking structure in the cured silicone rubber was broken by heat.

Comparative Example 2

A fixing belt was produced in the same manner as in Example 1 except that the titanium oxide crystal having an anatase type structure was changed to a titanium oxide crystal having a rutile type structure (trade name: titanium oxide (IV), rutile type: 99.9%, Model: 203-09413; produced by Wako Pure Chemical Industries, Ltd.).

The fixing belt was charged to an electric furnace set at 240° C., and a plurality of 20 mm-square rubber pieces were cut out from each of the fixing belts after a lapse of 16 hours, after a lapse of 40 hours, after a lapse of 56 hours, after a lapse of 72 hours, after a lapse of 100 hours and after a lapse of 124 hours in the same manner as in (1) above. The rubber pieces cut out from each of the fixing belts were stacked so that the thickness was 2 mm, and the micro hardness (Hμ2) of the laminate was measured by a Type C micro durometer. The results are shown in Table 3.

TABLE 3

| Elapsed time of heating (hours) | Hμ2 (degrees) |
|---|---|
| 0 | (Hμ0 = 27.9) |
| 16 | 26.0 |
| 40 | 24.1 |
| 56 | 22.4 |
| 72 | 21.6 |
| 100 | 20.1 |
| 124 | 20.8 |

Figure 7:
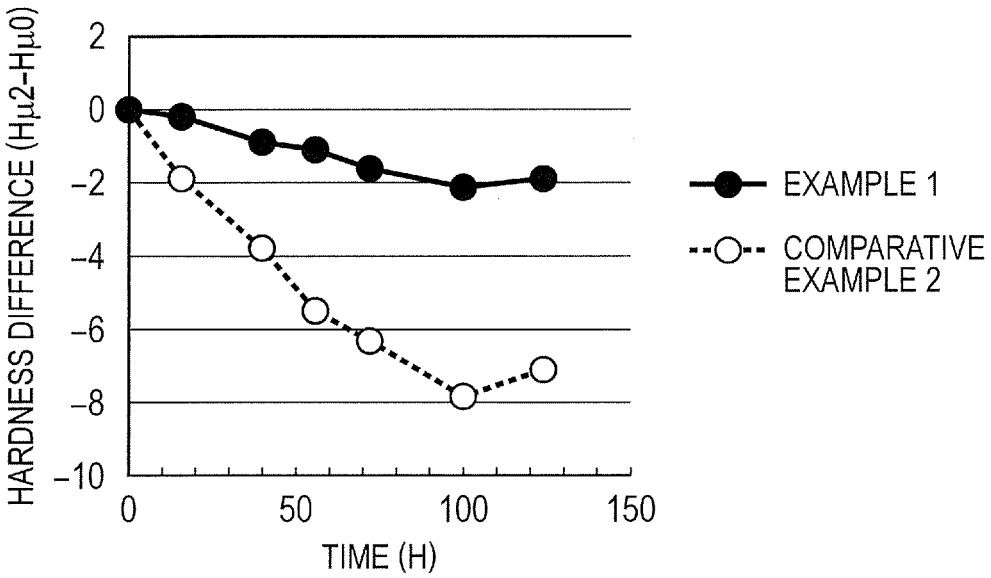
FIG. 7 is a graph illustrating a relationship between the heating time and the hardness difference of a fixing belt according to each of Example 1 and Comparative Example 2.

In addition, a graph illustrating a relationship between the hardness difference (=Hμ2−Hμ0) before and after heating and the heating time is illustrated in FIG. 7.

Furthermore, a relationship between the difference (Hμ2−Hμ0) between the hardness (Hμ2) and the hardness (Hμ0) before heating, the hardness being measured by charging the fixing belt according to Example 1 to an electric furnace set at 240° C. and stacking rubber pieces cut out from each of the fixing belts after a lapse of 16 hours, after a lapse of 40 hours, after a lapse of 56 hours, after a lapse of 72 hours, after a lapse of 100 hours and after a lapse of 124 hours so that the thickness was 2 mm, and the heating time was plotted together in FIG. 7.

It can be seen from FIG. 7 that the decrease in hardness after a lapse of 100 hours of heating is significantly suppressed in the fixing belt according to Example 1 containing the titanium oxide crystal having an anatase type structure, as compared with the fixing belt according to Comparative Example 2 containing the titanium oxide crystal having a rutile type structure.

Comparative Example 3

A fixing belt was produced in the same manner as in Example 1 except that the titanium oxide crystal was not added at all. The fixing belt was loaded to an electric furnace set at 240° C., and a plurality of 20 mm-square rubber pieces were cut out from the fixing belt after a lapse of 100 hours in the same manner as in (1) above. The rubber pieces were stacked so that the thickness was 2 mm, and the micro hardness (Hμ2) of the laminate was measured by a Type C micro durometer. The difference (=Hμ2−Hμ0) from the hardness (Hμ0) before heating is shown in Table 4.

Examples 2 to 6 and Comparative Examples 4 to 7

In each of the addition curing type silicone rubber compositions, the thickness of the coating film of the addition curing type silicone rubber composition, the amount of the thermally conductive filler compounded, the amount of the titanium oxide crystal having an anatase type structure compounded, and the ratio of the number of unsaturated aliphatic groups (vinyl groups) to the number of active hydrogen groups (Si—H groups) were changed as recited in Table 4. Each fixing belt was produced in the same manner as in Example 1 except for such conditions. The resulting fixing belt was evaluated in the same manner as in Comparative Example 3. The evaluation results are shown together in Table 4.

In Examples 5 to 6 and Comparative Examples 6 to 7, the following fillers were used.

Example 5 and Comparative Example 6: high-purity truly spherical alumina (trade name: Alunabeads CB-A20S; produced by Showa Titanium Co., Ltd.)

Example 6 and Comparative Example 7: high-purity truly spherical alumina (trade name: Alunabeads CB-A25BC; produced by Showa Titanium Co., Ltd.)

TABLE 4

| | Thickness of cured silicone rubber layer (μm) | Amount of filler (% by volume) | Amount of titanium oxide crystal compounded (part(s) by mass) | Ratio of number of active hydrogen groups to number of unsaturated aliphatic groups | Rate of increase in hardness (Hμ1/Hμ0) | Change in hardness after heat resistance test for 100 hours (Hμ2 − Hμ0) |
|---|---|---|---|---|---|---|
| Example 1 | 300 | 40 | 2 | 0.30 | 2.3 | −2.1 |
| Comparative Example 1 | 300 | 45 | 0 | 1.00 | 1.1 | −8.6 |
| Comparative Example 2 | 300 | 40 | 2 (Rutile type) | 0.30 | 2.3 | −7.8 |

TABLE 4-continued

| | Thickness of cured silicone rubber layer (μm) | Amount of filler (% by volume) | Amount of titanium oxide crystal compounded (part(s) by mass) | Ratio of number of active hydrogen groups to number of unsaturated aliphatic groups | Rate of increase in hardness (Hμ1/Hμ0) | Change in hardness after heat resistance test for 100 hours (Hμ2 − Hμ0) |
|---|---|---|---|---|---|---|
| Comparative Example 3 | 300 | 40 | 0 | 0.30 | 2.3 | −8.0 |
| Example 2 | 300 | 40 | 3 | 0.48 | 1.7 | −5.3 |
| Example 3 | 300 | 40 | 1 | 0.48 | 1.7 | −6.6 |
| Comparative Example 4 | 300 | 40 | 0 | 0.48 | 1.7 | −10.4 |
| Example 4 | 300 | 45 | 3 | 0.70 | 1.5 | −7.0 |
| Comparative Example 5 | 300 | 45 | 0 | 0.70 | 1.5 | −10.9 |
| Example 5 | 200 | 40 | 3 | 0.40 | 4.1 | −4.6 |
| Comparative Example 6 | 200 | 40 | 0 | 0.40 | 4.1 | −9.5 |
| Example 6 | 500 | 60 | 2 | 0.30 | 5.0 | −2.6 |
| Comparative Example 7 | 500 | 60 | 0 | 0.30 | 5.0 | −8.5 |

Image Quality Evaluation Test

Each of the fixing belts according to Example 1, Comparative Example 2 and Comparative Example 3, in which the rate of increase in hardness (Hμ1/Hμ0) of the elastic layer was "2.3", was mounted to a color laser printer (trade name: Satera LBP5900, manufactured by Canon Inc.) to output electrophotographic image α. In order to confirm the influence of the change in hardness at the initial stage of use of a product, the fixing belt was charged to an electric furnace set at 240° C., continuously heated for 100 hours to perform a heat resistance test, and then mounted to a color laser printer to output electrophotographic image β.

The difference in quality between electrophotographic image α and electrophotographic image β is changed depending on the magnitude of the change in hardness of the fixing belt by the heat resistance test. That is, in the case where the change in hardness of the fixing belt is smaller, the difference in quality between both the electrophotographic images is smaller, and thus such a case is advantageous for maintaining an image quality.

Herein, electrophotographic image α and electrophotographic image β were formed on almost over the surface of an A4-size printing sheet (trade name: PB PAPER GF-500, manufactured by Canon Inc., 68 g/m$^2$) by a cyan toner and a magenta toner in a density of 100%. The resultant was used as an evaluation image, electrophotographic image α and electrophotographic image β were compared by visual observation, and the degree of change in image quality thereof was rated on a 4-point scale. The results are shown in Table 5 below.

<Evaluation Criteria of Change in Image Quality>

Whether any change in image quality between electrophotographic image α and electrophotographic image β was observed or not was visually determined by five subjects, and the results were rated according to the following criteria.

Rank A: all of five subjects determined that "change in image quality was little".

Rank B: four subjects determined that "change in image quality was little".

Rank C: three subjects determined that "change in image quality was little".

Rank D: two or less subjects determined that "change in image quality was little".

TABLE 5

| | Evaluation result |
|---|---|
| Example 1 | A |
| Comparative Example 2 | C |
| Comparative Example 3 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-179956, filed Aug. 30, 2013, which is hereby incorporated by reference herein in its entirety.

What is claimed is:

1. An electrophotographic fixing member comprising:

a substrate;

a cured silicone rubber layer comprising an unsaturated aliphatic group and a titanium oxide crystal having an anatase type structure; and a fluorine resin layer adhered on the cured silicone rubber layer by an addition curing type silicone rubber adhesive, wherein when a micro hardness of a cured silicone rubber constituting the cured silicone rubber layer is designated as Hμ0, and a micro hardness of a rubber obtained by soaking the cured silicone rubber in a methyl hydrogen silicone oil for 24 hours and then further curing the cured silicone rubber, is designated as Hμ1, Hμ1/Hμ0 is from 1.5 to 5.0.

2. The electrophotographic fixing member according to claim 1, wherein a rate of rutile of titanium oxide comprised in the cured silicone rubber layer is 50% or less.

3. The electrophotographic fixing member according to claim 2, wherein the rate of rutile of titanium oxide comprised in the cured silicone rubber layer is 20% or less.

4. The electrophotographic fixing member according to claim 1, wherein a thickness of the cured silicone rubber layer is from 100 μm to 500 μm.

5. The electrophotographic fixing member according to claim 1, wherein the cured silicone rubber layer is a cured product of an addition curing type silicone rubber composition comprising an addition curing type silicone rubber stock liquid, the addition curing type silicone rubber stock liquid comprising:

an addition curing type silicone rubber; and the titanium oxide crystal having the anatase type structure, and wherein the addition curing type silicone rubber stock liquid has the titanium oxide crystal having the anatase type structure in a proportion of 0.2 parts by mass to 20 parts by mass based on 100 parts by mass of the addition curing type silicone rubber stock liquid.

6. The electrophotographic fixing member according to claim 1, wherein the unsaturated aliphatic group is a vinyl group.

7. A fixing apparatus comprising:

the electrophotographic fixing member according to claim 1; and a heating unit for the electrophotographic fixing member.

8. An electrophotographic image forming apparatus comprising:

an image formation unit having an electrographic photosensitive member;

an image transferring unit; and a fixing unit, wherein the fixing unit comprises the fixing apparatus according to claim 7.

9. The electrophotographic fixing member according to claim 1, wherein the fluorine resin layer is a fluorine resin tube.

* * * * *